US005246161A

United States Patent [19]

Kapp

[11] Patent Number: 5,246,161

[45] Date of Patent: Sep. 21, 1993

[54] BOX WITH COLLECTIBLE CARD

[76] Inventor: Mort Kapp, 4141 W. Belmont #408, Chicago, Ill. 60641

[21] Appl. No.: 13,793

[22] Filed: Feb. 5, 1993

[51] Int. Cl.[5] ..... B65D 5/42

[52] U.S. Cl. ..... 229/103; 206/459.5; 229/152

[58] Field of Search ..... 229/103, 152, 153; 206/44 R, 45.29, 459.5, 831; 40/312

[56] References Cited

U.S. PATENT DOCUMENTS

| | | | |
|---|---|---|---|
| 1,116,043 | 11/1914 | Elliott | 206/831 |
| 1,303,934 | 5/1919 | Mace | 206/459.5 |
| 2,005,135 | 6/1935 | Esterson | 206/459.5 |
| 2,332,287 | 10/1943 | Zalkind . | |
| 3,100,642 | 8/1963 | Goldstein | 206/459.5 |
| 3,183,614 | 5/1965 | Loderhose . | |
| 3,207,411 | 9/1965 | Farquhar . | |
| 3,606,135 | 9/1971 | Rosenburg, Jr. | 206/459.5 |
| 3,690,542 | 9/1972 | Jernstrom . | |
| 4,635,795 | 1/1987 | Deflander et al. | 206/44 R |
| 4,648,548 | 3/1987 | Shin | 40/312 |
| 4,696,401 | 9/1987 | Wallace . | |
| 4,834,240 | 5/1989 | Dagostine . | |
| 4,872,555 | 10/1989 | Shadrach, II et al. | 206/459.5 |
| 4,966,285 | 10/1990 | Otake et al. | 206/459.5 |
| 5,110,038 | 5/1992 | Pantisano et al. | 229/103 |

FOREIGN PATENT DOCUMENTS

| | | | |
|---|---|---|---|
| 455048 | 11/1991 | European Pat. Off. | 206/831 |
| 3326653 | 2/1985 | Fed. Rep. of Germany | 206/459.5 |

OTHER PUBLICATIONS

Copy of box of Kellogg's Frosted Flakes.
Copy of box of Kellogg's Apple Jacks.
Copy of box of Kellogg's Corn Pops.
Copy of box of Kellogg's Cocoa Krispies.
Copy of box of Kellogg's Froot Loops.
Copy of box of Kellogg's Corn Flakes.
Copy of box of General Mills Wheaties.

*Primary Examiner*—Gary E. Elkins
*Attorney, Agent, or Firm*—Jacobson, Price, Holman & Stern

[57] ABSTRACT

A box having a collectible card forming part of a cover of the box and which is detachable from the box and detachable from a closure flap of the cover. The detached collectible card can be stored in the box along with other collectible cards.

9 Claims, 2 Drawing Sheets

BOX WITH COLLECTIBLE CARD

FIELD OF THE INVENTION

This invention relates to a box having a collectible card forming part of a cover of the box and which is detachable from the box and detachable from a closure flap of the cover. The detached collectible card can be stored in the box along with other collectible cards.

BACKGROUND OF THE INVENTION

Children have always had an attraction to the collection of different types of playing cards. This attraction has not been limited to baseball, football, or other sports-type cards but extends to different types of cards depicting action figures, action scenes, television characters or any other cards forming a finite series of cards, with the goal being to collect all the cards within a particular series.

It has also been a goal of entrepreneurs to attract the attention of the consuming public, and particularly children to purchase a particular item by the attraction of the consuming public to a secondary product unrelated to the primary purchased product. Towards this goal, cereal boxes, for example, often include cut-out cards or other associated paraphernalia which are desired by children. Therefore, a purchase is often induced by the attraction to a collectible card which forms only a small portion of an overall container, with the card having no further associated with the box or to the contents of the box which is being purchased.

SUMMARY OF THE INVENTION

It is an object of the present invention to induce purchasers of a product contained in a box by drawing the attention of the potential purchaser to the box by the use of a collectible card. The collectible card forms a portion of the cover to the box. The box is sized to the same size as the collectible card so that when the collectible card is detached from an edge of the box and an opposed edge of a closure flap, and the contents of the box are removed, the box can serve as a storage container for a plurality of different collectible cards forming a series of collectible cards or other standard sized ($2\frac{1}{2} \times 3\frac{1}{2}$) collectible cards.

Both sides of the collectible card contain indicia, with one side of the card preferably depicting an illustration, and an opposite side of the card including a description of the illustration and other information associated with the illustration and with respect to a numbering of a particular series of collectible cards.

It is another object of the present invention to form a box having a cover formed in two portions with the collectible card forming a major portion of the cover to the box and a closure flap forming a minor portion of the cover, with the collectible card connected to the box along a scored, perforated edge and connected on an opposite edge to the closure flap along another scored, perforated line.

It is still another object of the present invention to form a box having a cover formed in two portions with the collectible card forming a major portion of the cover to the box and a closure flap forming a minor portion of the cover, with the collectible card connected to the box along a scored, perforated edge and connected on an opposite edge to the closure flap along another scored, perforated line with the dimensions of the card being equal to the dimensions of the interior of the box so that the box forms a storage container for a plurality of cards in the box.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
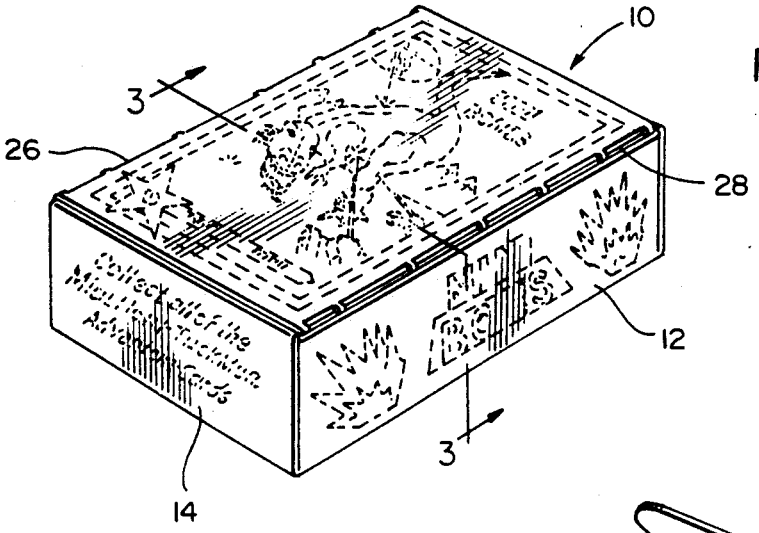
FIG. 1 is a front perspective view of a box having a cover, part of which forms a collectible card.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
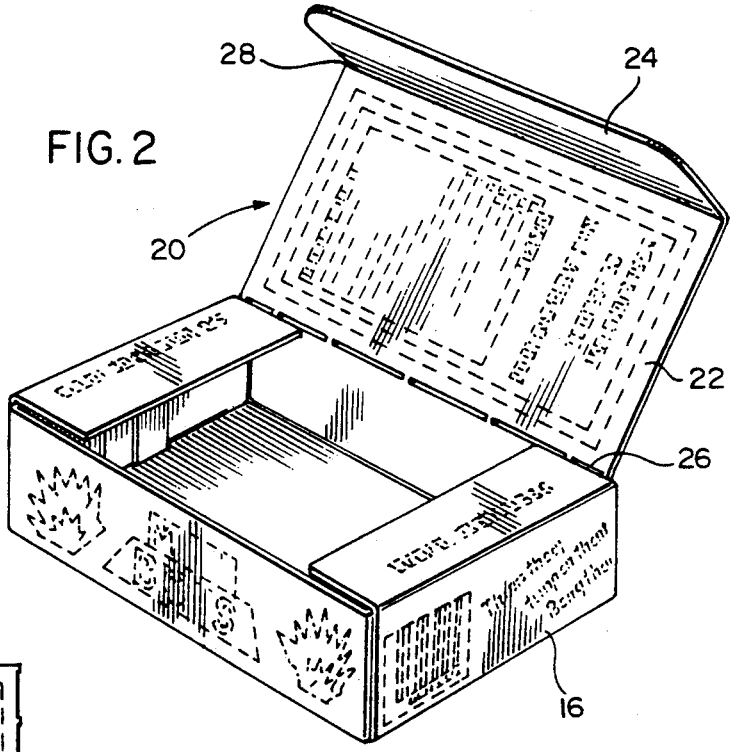
FIG. 2 is an alternate front perspective view of the box with the cover in an open position.

With reference to the drawings, in general, and to FIGS. 1 and 2, in particular, a box providing the teachings of the subject invention is generally designated as 10. Box 10 includes a front panel 12, two side panels 14 and 16, rear panel 18, and bottom panel 20. preferably, the box is made of thin cardboard or reinforced paper.

The cover 20 is formed of two portions. The first portion 22, forming a majority of the cover, is a collectible card. The other portion 24, forming a minority of the cover, is a closure flap, which as shown in FIG. 1, fits into the interior of the formed box so as to close the box.

The collectible card 22 serves as a top cover to the box 10 when the box is originally sold with its contents, for example candy, trick noise makers, etc. After the contents of the box have been depleted, the collectible card 22 is detached from the remainder of the box by separation from the box along perforated score line 26 located on one edge of the card. On an opposite edge of the card is a perforated score line 28 which connects the collectible card 22 to the closure flap 24. The dimensions of the collectible card 22 are preferably equal to the size of a standard sports figure card, or two and one-half inches wide by three and one-half inches long.

In addition, the bottom panel 20 of the box 10 is similarly of a size of two and one-half inches wide by three and one-half inches long. By having the collectible card 22 equal in dimensions to the interior of the box 10, once the contents of the box have been emptied, the collectible card will fit within the box so that the box has a secondary purpose for storage of collectible cards.

Figure 5:
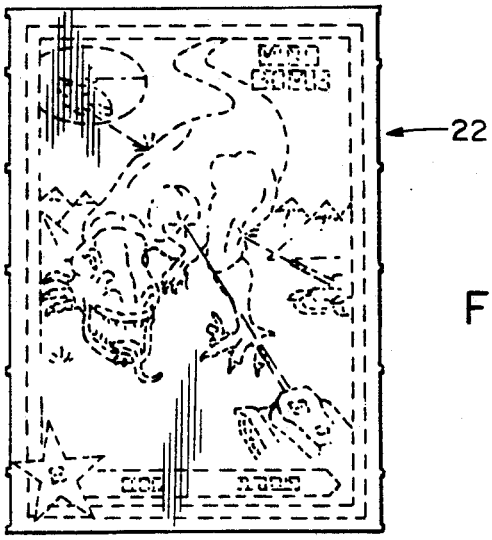
FIG. 5 is a top view of a collectible card detached from the box and detached from a closure flap of the cover.
Figure 3:
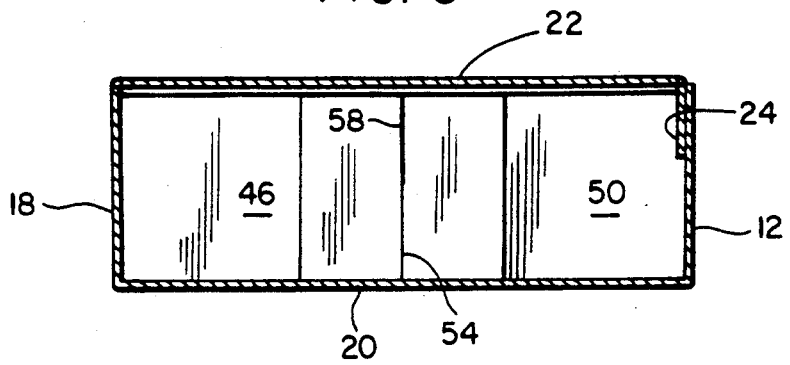
FIG. 3 is a sectional view taken along line 3—3 of FIG. 1.

As indicated in dotted lines in FIG. 5, the front 30 of the collectible card includes an action scene, for example. The rear face 32 of the collectible card 22 includes a description of the action scene from the front face 30 and includes a numbering of the card of a series of cards. The consumer is urged to collect all the cards in the collect-a-card series to obtain a complete set of cards.

The other exposed surfaces of the box includes advertising indicia to urge the consumer to buy the contained product with the additional benefit of having a collectible card storable within the empty box.

Figure 4:
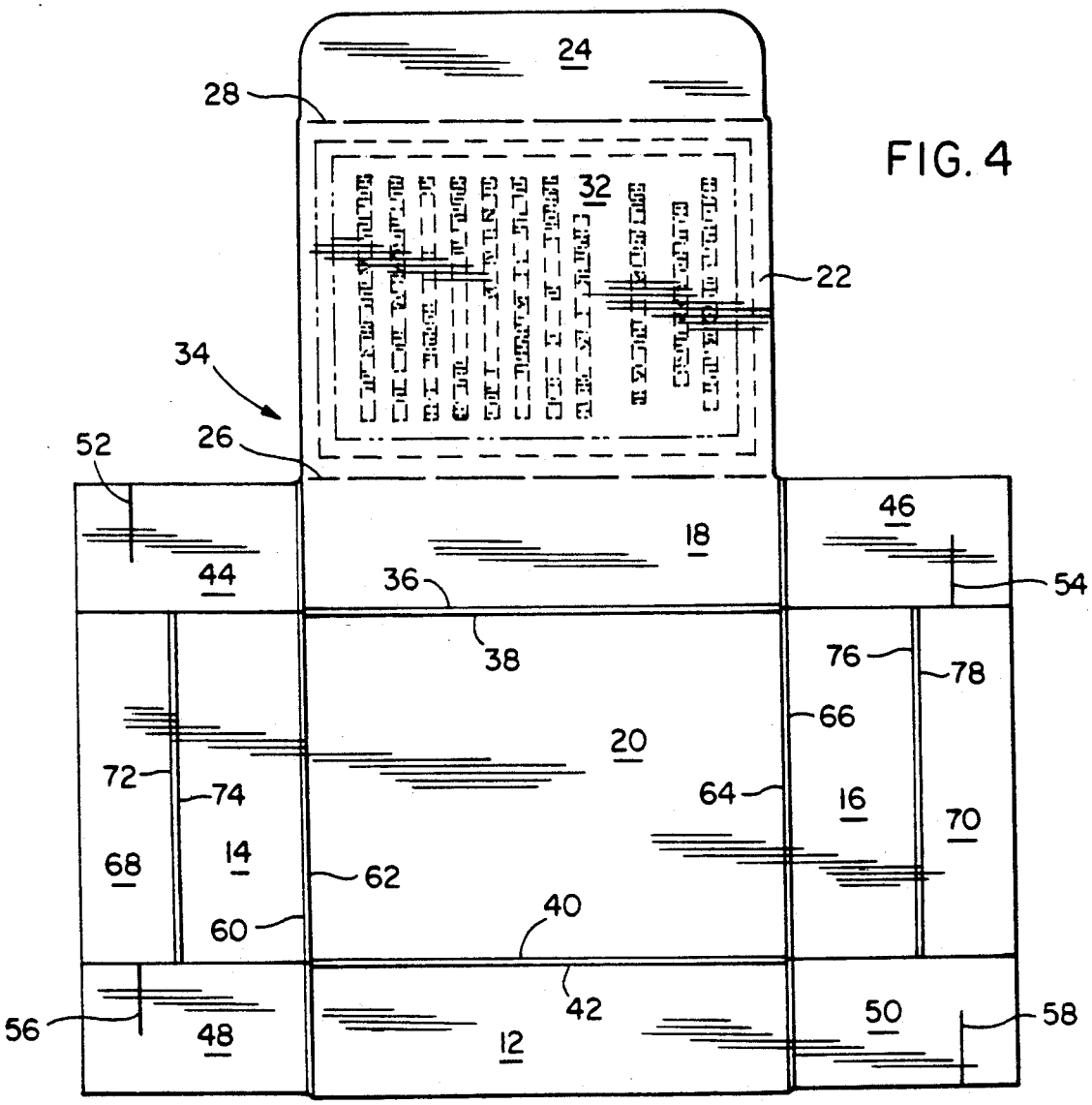
FIG. 4 is an unfolded plan view of a blank for the box.

In FIG. 4, an unfolded box blank 34 is shown. Perforated score lines 26 and 28 are contrasted with the remaining fold lines which interconnect the remaining portions of the box and which are not intended to separate additional portions from the box. Rear panel 18 is connected to bottom panel 20 by double fold lines 36, 38. Similarly, front panel 12 is connected to bottom panel 20 by double fold lines 40, 42. Extending outwardly from rear and front panels 18, 12 are extended panel portions 44, 46 and 48, 50, respectively. Each of the extended panel portions 44, 46, 48, and 50 include a slit 52, 54, 56, and 58, respectively.

Side panel 14 is connected to bottom panel 20 by double fold lines 60, 62 and opposite side panel 16 is connected to bottom panel 20 by double fold lines 64, 66. Side panels 14 and 16 include extended panel portions 68, 70 connected by double fold lines 72, 74 and 76, 78, respectively.

To form box 10, front and rear panels 12, 18 are folded along their respective fold lines at an angle of 90° with respect to bottom panel 20. At this point, extended panel portions 44, 46, 48, and 50 are folded 90° in a direction towards bottom panel 20 so as to overlap panel portions 44 and 48 and to overlap panel portions 46 and 50. Slits 52 and 56 are inter-engaged to secure extended panel portions 44 and 48 together and similarly, slits 54 and 58 are inter-engaged to secure together extended side panel portions 46 and 50.

At this point, side panels 14 and 16 are folded along their respective fold lines at an angle of 90° with respect to the bottom panel 20 and extended panel portions 68 and 70 are then folded another 90° downwardly towards bottom panel 20 into a position as shown in FIG. 2. Alternately, extended panel portions 68 and 70 may be of increased width so as to fold over side panels 14 and 16, respectively, and frictionally engage bottom panel 20 to secure the side panels 14 and 16 in place.

Upon separation of collectible card 22 from rear panel 18 along perforated score line 26 and separation of closure flap 24 from collectible card 22 along perforated score line 28, collectible card 22 may be associated with a plurality of other collectible cards. Alternately, the collected cards may be stored in the box formed by bottom panel 20, front and rear panels 12 and 18, and side panels 14 and 16.

Having described the invention, many modifications thereto will become apparent to those skilled in the art to which it pertains without deviation from the spirit of the invention as defined by the scope of the appended claims.

I claim:

1. A box comprising:

a bottom panel, a front panel secured to said bottom panel, a rear panel secured to said bottom panel, two side panels secured to said bottom panel, and a cover including a collectible card and a closure flap, said collectible card being secured along one edge by a perforated score line to said rear panel, said closure flap being secured to said collectible card along another edge of said collectible card by a perforated score line.

2. A box as claimed in claim 1, wherein said collectible card and said bottom panel are substantially the same size.

3. A box as claimed in claim 2, wherein said collectible card is 2.5 inches wide and 3.5 inches long.

4. A box as claimed in claim wherein said collectible card includes indicia on a front face and a rear face.

5. A box as claimed in claim 1, wherein said one edge and said another edge are located opposite each other.

6. A box as claimed in claim 1, wherein opposed edges of said collectible card extending between said one edge and said another are free of attachment to other portions of the box.

7. A box as claimed in claim 1, wherein a plurality of collectible cards are storable in the box.

8. A box as claimed in claim 1, wherein said collectible card depicts an action scene on a front face of said collectible card.

9. A box as claimed in claim 8, wherein a rear face of said collectible card includes numeral indicia to identify each collectible card as originating from a series of cards.

* * * * *